US006860482B2

(12) United States Patent
Kim

(10) Patent No.: US 6,860,482 B2
(45) Date of Patent: Mar. 1, 2005

(54) FRAMED DARTBOARD

(76) Inventor: Yong Cheol Kim, 101-617 Ho Seong Weon, Apt. 783, Shinnae-Dong, Chunnang-Gu, Seoul (KR)

( * ) Notice: Subject to any disclaimer, the term of this patent is extended or adjusted under 35 U.S.C. 154(b) by 0 days.

(21) Appl. No.: 10/341,560

(22) Filed: Jan. 14, 2003

(65) Prior Publication Data

US 2004/0032087 A1 Feb. 19, 2004

(30) Foreign Application Priority Data

Aug. 19, 2002 (KR) ..... 20-2002-0024626

(51) Int. Cl.[7] ..... A63B 63/00
(52) U.S. Cl. ..... 273/348.3
(58) Field of Search ..... 273/348.3, 119 A, 273/126 A, 239; 473/FOR 209

(56) References Cited

U.S. PATENT DOCUMENTS 2,562,089 A * 7/1951 Fishlove ..... 273/348.3
3,170,693 A * 2/1965 Felsher ..... 273/348.3
5,005,841 A * 4/1991 Klick ..... 273/348.3
5,967,520 A 10/1999 Chen ..... 273/348.3
6,517,075 B1 * 2/2003 Yoon ..... 273/348.3

FOREIGN PATENT DOCUMENTS

GB 2254010 A * 9/1992 ..... A63F/3/00

* cited by examiner

*Primary Examiner*—Mark S. Graham
(74) *Attorney, Agent, or Firm*—St. Onge Steward Johnston & Reens LLC

(57) ABSTRACT

The present invention relates to a framed dartboard in which a magnetic rubber pad is combined with a case member of a picture frame that can provide interior decorations for the dartboard. The framed dartboard comprises a case member forming an outer case of the framed dartboard, a printed plate at least partially enclosed within the case member and containing designs related to a dart game, a magnetic rubber pad disposed at a rear side of the printed plate for attaching a magnetic dart, an elastic member disposed at a rear side of the magnetic rubber pad to absorb an impact force by the magnetic dart, a back plate which is disposed at a rear side of the elastic member, and a hanger portion for attaching the framed dartboard to a suitable external structure.

8 Claims, 7 Drawing Sheets

FRAMED DARTBOARD

BACKGROUND OF THE INVENTION

1. Field of the Invention

The present invention relates to a framed dartboard, and more particularly to a framed dartboard in which a magnetic rubber pad is enclosed in a case member of a picture frame that can provide interior decorations or game designs.

2. Description of the Related Art

In a conventional dart game, the dart game is typically designed to utilize a magnet formed at the distal end of a dart which can be adhered to the dartboard made of a steel plate. But such a dart game has a problem concerning the noise generated at the moment when the dart thrown comes into contact with the dartboard.

To solve such a noise problem, a soft sheet dartboard has been introduced. However, because the dartboard can be flexibly swung back and forth as it is made of a soft material, it produces other problems. At the moment when the magnet dart thrown by the user hits the dartboard, it can be slid off because the board cannot support the impact. For example, when the dart hits the outer periphery of the dartboard, it can be slid off with the soft sheet swung by the impact force of the magnetic dart; or especially when it hits a bottom side of the dartboard, it falls off after being slid by the weight of the magnet dart flying in a parabolic trajectory.

SUMMARY OF THE INVENTION

To solve such problems discussed above, it is an object of the present invention to provide a framed dartboard, in which a swing due to the impact of the magnetic dart is prevented when it hits the dartboard, and even if the magnetic dart flying in a parabolic trajectory hits a bottom side of the dartboard, it does not slide off as it is caught by a catch protruding outward.

It is another object of the present invention to provide a framed dartboard, wherein the aesthetic influence can be preserved in the outer appearance by maintaining the shape of the dartboard formed in a picture frame, and since it is easy to produce by assembling the components of the dartboard within a picture frame, workability and manufacturing efficiency can be improved.

In one aspect of the present invention, there is provided a framed dartboard, comprising: a case member forming an outer case of the framed dartboard; a printed plate at least partially closed within the case member and containing designs related to a dart game; a magnetic rubber pad disposed at a rear side of the printed plate for attaching a magnetic dart; an elastic member disposed at a rear side of the magnetic rubber pad to absorb an impact force by the magnetic dart; a back plate which disposed at a rear side of the elastic member; and a hanger portion for attaching the framed dartboard to a suitable external structure.

In one preferred embodiment of the present invention, the case member includes an outermost plane portion, a slope portion inwardly extending from the plane portion, a vertical portion vertically extending from the slope portion, a first stepped portion for receiving the printed plate, the magnetic rubber pad and the elastic member therein, and a second stepped portion defining a space for receiving the back plate therein.

In other preferred embodiments, the sloped angle of the slope portion is between 30 and 75 degrees.

In still further preferred embodiments, the case member is formed into a square, circular, elliptical or rhombic shape. In addition, a rope can be used for the case member, and the rope can be attached using a bonding means onto the front surface of the printed plate.

BRIEF DESCRIPTION OF THE DRAWINGS

Other objects and aspects of the present invention will become apparent from the following description of the embodiments with reference to the accompanying drawings, wherein.

DETAILED DESCRIPTION OF THE DRAWINGS

Figure 1:
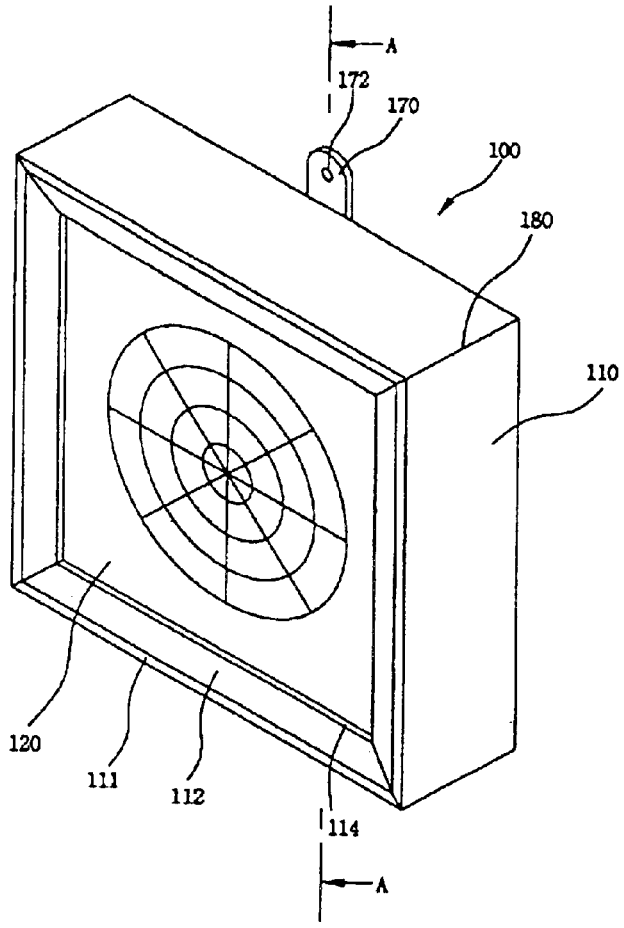
FIG. 1 is a perspective view of a framed dartboard of the present invention.

Hereinafter, the present invention will be described in more detail referring to the drawings.

Figure 2:
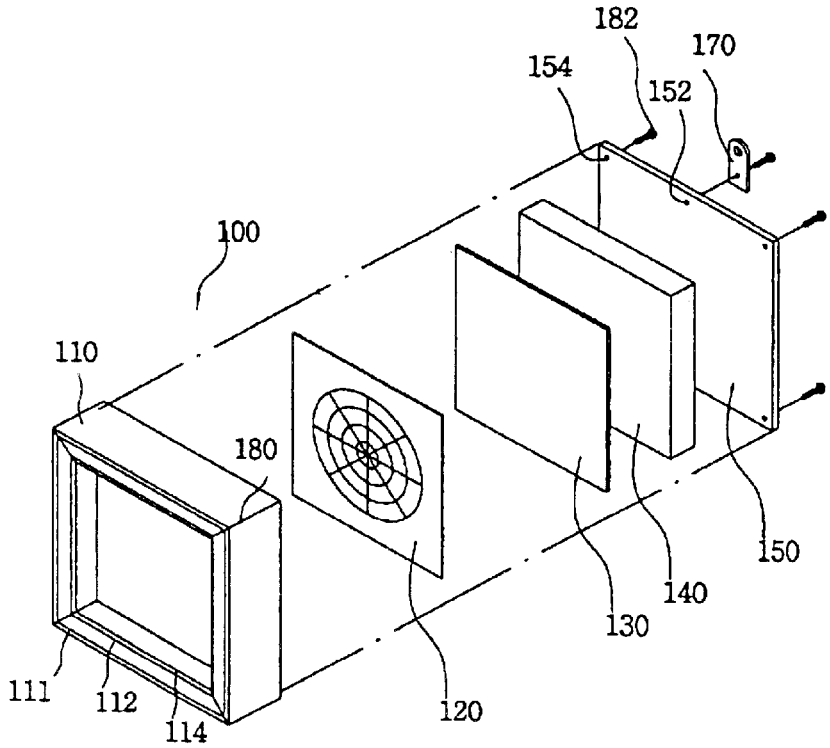
FIG. 2 is an exploded perspective view of the framed dartboard of the present invention.
Figure 3:
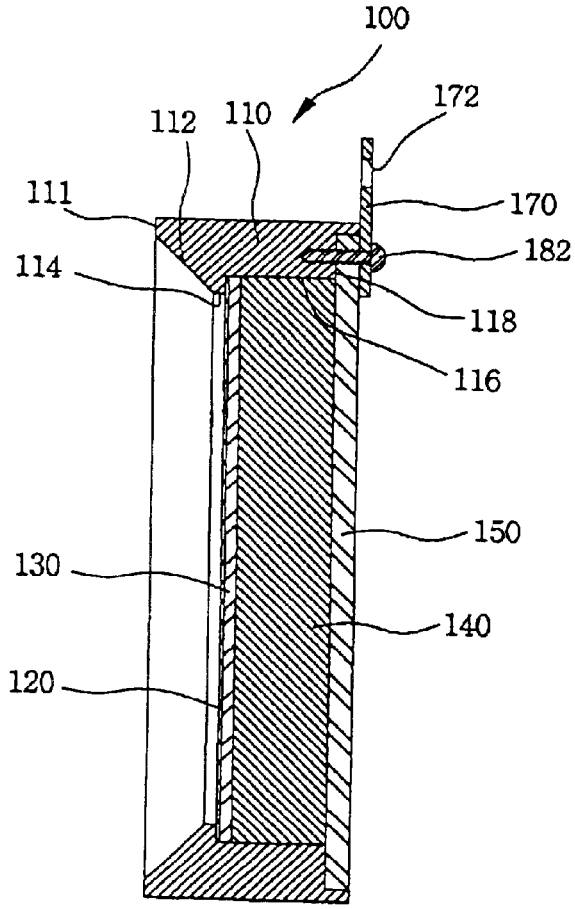
FIG. 3 is a cross sectional view taken on line A—A of FIG. 1.
Figure 4:
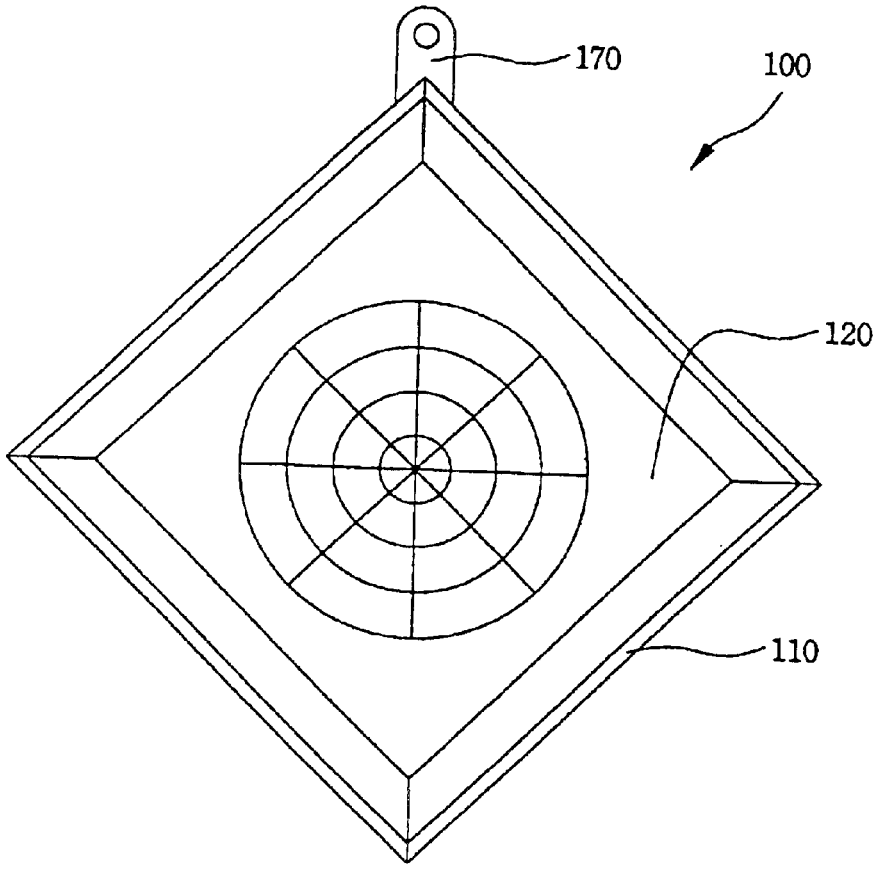
FIG. 4 shows another embodiment of the framed dartboard of the present invention.
Figure 5A:
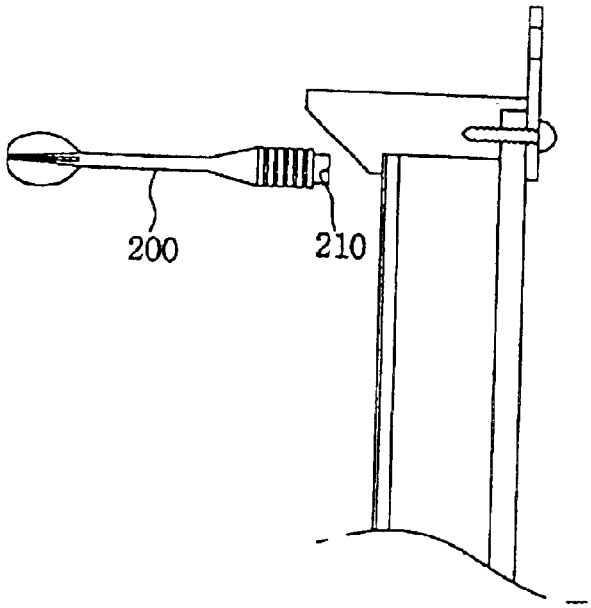
FIGS. 5*a* and 5*b* are schematic views showing the state in which a magnetic dart can be attached to the framed dartboard even if it comes into contact with the slope portion or vertical portion of the case member at the time of hitting.
Figure 5B:
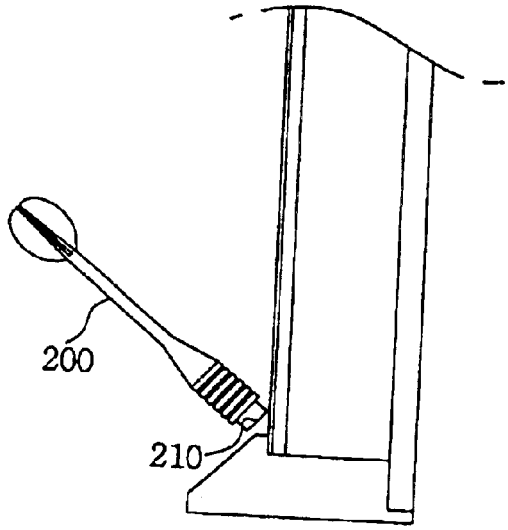

FIG. 1 is a perspective view of the framed dartboard of the present invention, and FIG. 2 is an exploded perspective of the framed dartboard of the present invention. Framed dartboard 100 of the present invention comprises case members 110, a printed plate 120 a magnetic rubber pad 130, an elastic member 140, and a back plate 150. Case members 110 form an outer case of the framed dartboard 100 and are connected together by a plurality of connecting means 180. Printed plate 120, is fitted within the enclosure of the case members 110 and contains designs related to the game. Magnetic rubber pad 130, is placed at the rear surface of the printed plate 120 so that a magnet member 210 (FIGS. 5*a* and 5*b*) formed at a distal end of magnet dart 200 can be adhered thereto. Elastic member 140 is placed at the rear surface of the magnetic rubber pad 130 made of iron particles and a resilient material to absorb the impact force by the magnetic dart 200. Back plate 150 is placed at the rear surface of the elastic member 140 to be connected into one unit by the case member 110 and a plurality of connection means 182. Hanger 170 is preferably provided, wherein it is connected by the connection means 182 to the framed dartboard 100.

The printed plate 120, magnetic rubber pad 130, elastic member 140 and back plate 150 are preferably bonded with adhesives of known types to connect into one unit. However, it is more preferred that the print member 120, magnetic rubber pad 130 and elastic member 140 are adhered by adhesives but the elastic member 140 and back plate 150 are not adhered by adhesives.

The case members 110 are so formed as to make the four members connect with one another, and these four members are bonded with the joints adhered at an angle of 45 degrees each other. In this disclosure, the connecting means 180 is intended to include bond or adhesives, a staple or tack, or other commonly used means similar to these, and such a connection can be performed using more than one of these means.

The case members 110 can be formed with synthetic resin, metal, wood or the like.

A rope or elongate frame member can be used for the case members 110, and they can be connected using a bonding means such as silicone and adhesives that are commonly used on the peripheral surface of the printed plate 120.

Further, the case members 110 are formed with a plurality of surfaces consisting of a plane portion 111 that forms an outermost face, a slope portion 112 that extends inwards from the plane portion 111, a vertical portion 114 that extends vertically from the slope portion 112, a first stepped portion 116 that provides a space for the printed plate 120, the magnetic rubber pad 130 and the elastic member 140 to mount on, and a second stepped portion 118 that provides a space for the back plate 150 to mount on.

Namely, it is desirable to form the sloped angle of the slope portion 112 typically at 30 to 75 degrees which can alternatively be formed concave or convex depending on the design of the dart board. So even if the magnet member 210 of the magnetic dart 200 hits the slope portion 112, it is moved along the sloped portion to be adhered to the inside of the framed dartboard 100.

In case the magnet member 210 of the magnet dart 200 flies in a parabolic trajectory and hits the vertical portion 114, which is an inner part of the case member 110, the vertical portion 114 guides the magnet member 210 so it will not slide off. The height of the vertical portion 114 is formed greater than a half of the diameter of the magnet member 210. However, it is more preferable to make it the same or greater than the diameter of the magnet member 210 to prevent the magnet dart 200 from sliding off.

In addition, the printed plate 120, on which drawings and numbers for various dart games are printed according to the design of the dart board, is formed with paper or synthetic resin, or fabric.

The magnetic rubber pad 130 is preferably made with commonly used magnetic rubber materials having a preferable mixing ratio of 90% or more of iron powder (Fe powder) and 10% or less of synthetic rubber or natural rubber. It can absorb the impact of the magnet member 210 of the magnetic dart 200. When using a flexible magnetic pad 130, the thinner the thickness of the sheet, the greater is the ability to absorb the impact.

Further, the elastic member 140 is made of a synthetic resin material such as shape-restorable polyurethane, polyether foam or slow recovery foam, a corrugated cardboard material (that can be formed of paper or a synthetic resin material), or Styrofoam, so that the impact of the magnetic dart 200 can be further dispersed or absorbed to reduce the noise and falling-off.

The back plate 150 can be made of plastic or wood, and a plurality of connection holes 152 and 154 are formed so that it can be connected to the case member 110 in one unit by the plurality of connection means 182.

On an upper portion of the hanger 170, there is formed a through hole 172 to hang on a wall or an appropriate structure.

The framed dartboard of the present invention is not limited to the embodiment described above. For example, the framed dartboard can be made into square, circular, elliptical, rhombic or other shapes.

Figure 6:
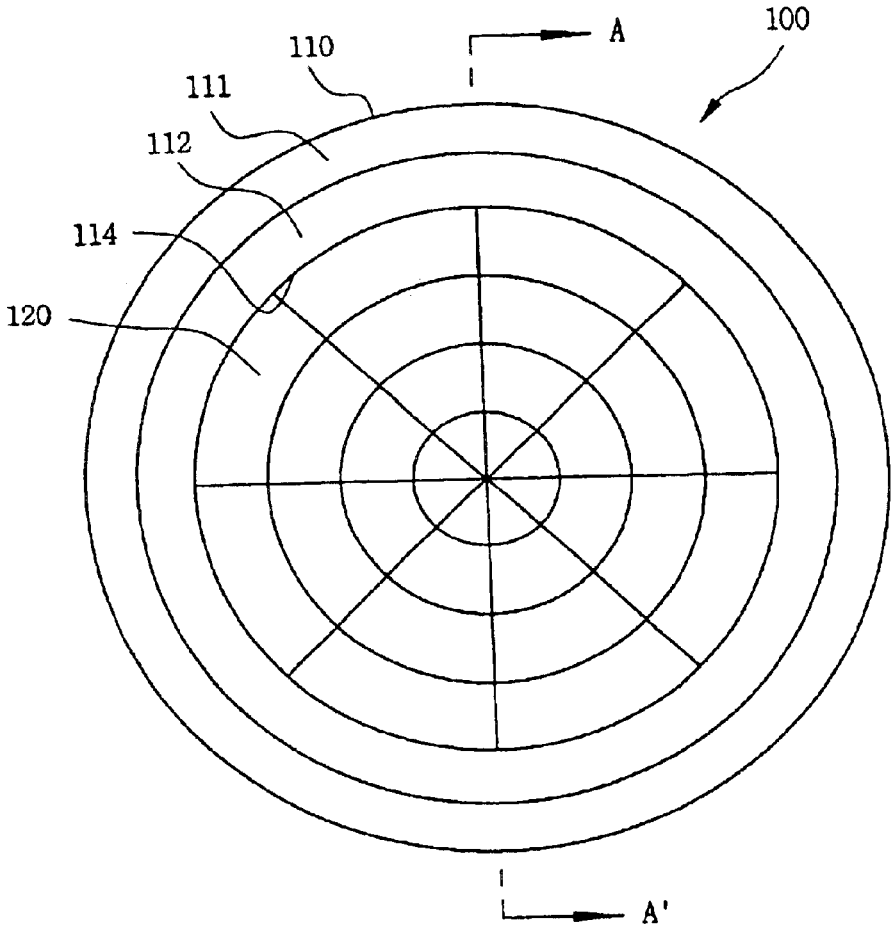
FIG. 6 is a front view showing a dartboard formed in a circular form instead of a rectangular frame form according to yet another embodiment of the present invention.
Figure 7:
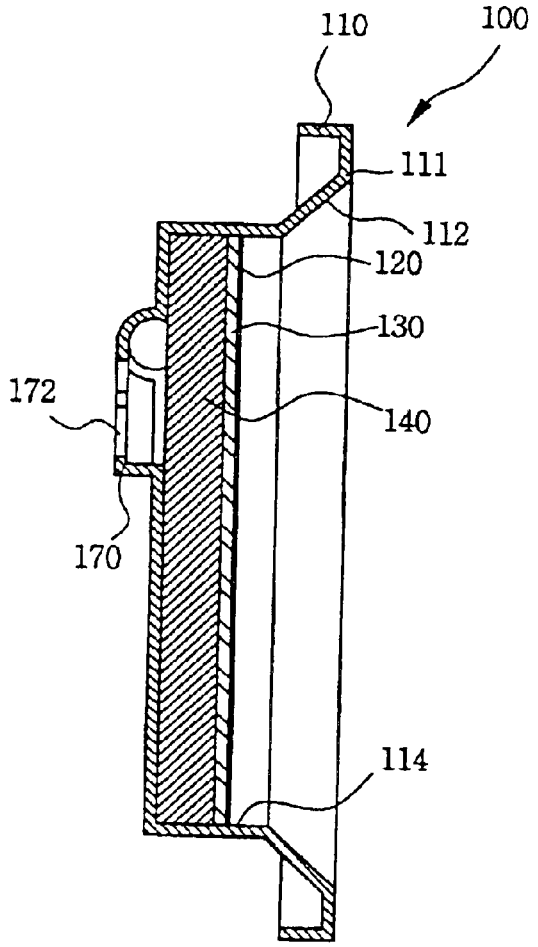
FIG. 7 is a cross section along the line A—A of FIG. 6.

Referring now to FIGS. 6 and 7, the difference in this embodiment from the embodiment described above is not only the shape of the frame—but in which the dartboard is formed in a circular shape. Here, it is also different in that the hanger 170 is formed in the case member 110 in one unit and the back plate, i.e. 150 in FIG. 2, is also formed in one unit with the case member 110. However, the slope portion 112 and the vertical portion 114, have same or similar structures and functions.

Although the preferred embodiments of the framed dartboard in accordance with the present invention have been described, it will be understood by those skilled in the art that the present invention should not be limited to the described preferred embodiments, but various changes and modifications can be made within the spirit and the scope of the present invention. Accordingly, the scope of the present invention is not limited to the above description but the following claims.

The framed dartboard of the present invention as described above is an invention whereby swinging or shaking due to the impact of the magnetic dart is prevented. Thus, even if the magnetic dart hits the bottom side of the dartboard in a parabolic trajectory, the magnet dart does not slide off as it is caught by a catch protruding outward. An aesthetic appeal can be preserved when seen from the outside by maintaining the appearance of the dartboard in a picture frame form, and workability and manufacturing efficiency can be improved because it is easy to produce by assembling into a picture frame form with the printed plate, magnetic rubber pad, elastic member and back plate coupled to form the dartboard.

What is claimed is:

1. A framed dartboard, comprising:

a case member forming an outer case of the framed dartboard;

a printed plate at least partially enclosed within the case member and containing designs related to a dart game;

a magnetic rubber pad disposed at a rear side of the printed plate for attaching a magnetic dart;

an elastic member disposed at a rear side of the magnetic rubber pad to absorb an impact force by the magnetic dart;

a back plate disposed at a rear side of the elastic member; and a hanger portion for attaching the framed dartboard to a suitable external structure.

2. The framed dartboard of claim 1, wherein the case member includes an outermost plane portion, a slope portion inwardly extending from the plane portion, a vertical portion vertically extending from the slope portion, a first stepped portion defining a space for receiving the printed plate, the magnetic rubber pad and the elastic member therein; and a second stepped portion defining a space for receiving the back plate therein.

3. The framed dartboard of claim 2, the slope portion has a slope angle between 30 and 75 degrees.

4. The framed dartboard of claim 1, wherein the case member is formed into a square or circular shape.

5. The framed dartboard of claim 1, wherein said printed plate, magnetic rubber pad, elastic member and back plate are formed in one unit adhered by adhesives.

6. The framed dartboard of claim 1, wherein said printed plate, magnetic rubber pad and elastic member are adhered by adhesives but said elastic member and back plate are not adhered to one another.

7. The framed dartboard of claim 1, wherein the elastic member is made of a synthetic resin material.

8. The framed dartboard of claim 1, wherein the elastic member is made of a corrugated cardboard material or Styrofoam.

* * * * *